US011791088B2

(12) United States Patent
Tobita et al.

(10) Patent No.: US 11,791,088 B2
(45) Date of Patent: Oct. 17, 2023

(54) MULTILAYER COIL COMPONENT

(71) Applicant: TDK CORPORATION, Tokyo (JP)

(72) Inventors: Kazuya Tobita, Tokyo (JP); Hajime Kato, Tokyo (JP); Makoto Yoshino, Tokyo (JP); Youichi Kazuta, Tokyo (JP); Yuto Shiga, Tokyo (JP); Noriaki Hamachi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 832 days.

(21) Appl. No.: 16/394,005

(22) Filed: Apr. 25, 2019

(65) Prior Publication Data

US 2019/0348214 A1 Nov. 14, 2019

(30) Foreign Application Priority Data

May 8, 2018 (JP) ..... 2018-090150

(51) Int. Cl.
*H01F 27/28* (2006.01)
*H01F 27/02* (2006.01)

(52) U.S. Cl.
CPC ..... *H01F 27/02* (2013.01); *H01F 27/2804* (2013.01); *H01F 2027/2809* (2013.01)

(58) Field of Classification Search
CPC ..... H01F 27/2804; H01F 17/0013; H01F 17/0006; H01F 5/003; H01F 27/29; H01F 27/292
USPC ..... 336/200, 232
See application file for complete search history.

(56) References Cited

U.S. PATENT DOCUMENTS

2002/0008606 A1* 1/2002 Okuyama ..... H01F 17/0013 336/200
2008/0257488 A1 10/2008 Yamano
2009/0153282 A1 6/2009 Taoka et al.
2012/0227250 A1 9/2012 Yamano
2013/0015937 A1 1/2013 Seko
2014/0375412 A1 12/2014 Seko
2015/0170834 A1 6/2015 Yamano
2016/0141102 A1* 5/2016 Tseng ..... H01F 27/292 336/200
2017/0256352 A1* 9/2017 Kido ..... H01F 27/2804
2019/0051450 A1* 2/2019 Shimoda ..... H01F 27/292
2020/0035405 A1 1/2020 Kido
(Continued)

FOREIGN PATENT DOCUMENTS

CN 107154300 A 9/2017
JP 2007-266219 A 10/2007
JP 2013-038392 A 2/2013
(Continued)

*Primary Examiner* — Tszfung J Chan
(74) *Attorney, Agent, or Firm* — Oliff PLC

(57) ABSTRACT

In a multilayer coil component 1, a coil 7 includes a first connection part 22*a* and a second connection part 26*a*, the first connection part 22*a* is connected to one end part of the coil 7, which part is placed on a side of one principal surface 2*c*, and is arranged in an identical dielectric layer 6 with a conductor 22 included in the one end part, the second connection part 26*a* is connected to the other end part of the coil 7, which part is placed on a side of the other principal surface 2*d*, and is arranged in an identical dielectric layer 6 with a conductor 26 included in the other end part, and recessed parts 8*a* and 8*b* and recessed parts 9*a* and 9*b* are respectively provided in the first terminal electrode 4 and the second terminal electrode 5 in the element body 2.

5 Claims, 8 Drawing Sheets

(56) References Cited

U.S. PATENT DOCUMENTS

2020/0343039 A1 10/2020 Kido

FOREIGN PATENT DOCUMENTS

| | | | | | | |
|---|---|---|---|---|---|---|
| JP | 2013038392 | A | * | 2/2013 | ..... | H01F 17/0013 |
| WO | 2007/055303 | A1 | | 5/2007 | | |
| WO | WO-2007055303 | A1 | * | 5/2007 | ..... | H01F 17/0013 |
| WO | 2007/080680 | A1 | | 7/2007 | | |
| WO | WO-2007080680 | A1 | * | 7/2007 | ..... | H01F 17/0013 |

* cited by examiner

MULTILAYER COIL COMPONENT

TECHNICAL FIELD

The present invention relates to a coil component.

BACKGROUND

As a multilayer coil component in a related art, for example, what is described in WO 2007/055303 has been known. A multilayer coil component described in WO 2007/055303 includes an element body having a pair of end surfaces facing each other, a pair of principal surfaces facing each other, and a pair of side surfaces facing each other, a coil which is arranged in the element body and an axis of which is in a facing direction of the pair of principal surfaces, and a terminal electrode arranged in the element body. In the multilayer coil component described in WO 2007/055303, a terminal electrode is buried on a side of a mounting surface of the element body, and one end part of the coil is connected to a terminal electrode via a through hole conductor extended in the facing direction.

SUMMARY

In a multilayer coil component in a related art, one end part of a coil and a terminal electrode are connected by a through hole conductor. In this configuration, connection reliability of the coil and the terminal electrode may be decreased. Thus, in the multilayer coil component, it is preferable that the terminal electrode is arranged in a position where the one end part of the coil is provided and that the one end part of the coil and the terminal electrode are connected. With this arrangement, it is possible to avoid the problem of a decrease in connection reliability since the one end part of the coil and the terminal electrode can be joined without the through hole conductor. However, in this configuration, a distance between a terminal electrode and a coil arranged in an element body becomes short. With this configuration, it is likely that a magnetic flux of the coil passes through the terminal electrode, and there is a possibility that a Q-value is decreased due to a loss by an eddy current.

One aspect of the present invention is to provide a coil component that can control a decrease in a Q-value while securing reliability of connection between a coil and a terminal electrode.

A multilayer coil component according to one aspect of the present invention includes: an element body that is formed by lamination of a plurality of dielectric layers and that has a pair of end surfaces facing each other, a pair of principal surfaces facing each other, and a pair of side surfaces facing each other; a coil that is configured by connection of a plurality of conductors and that is arranged in the element body; and a first terminal electrode and a second terminal electrode respectively arranged on sides of the pair of end surfaces of the element body, wherein a coil axis of the coil is extended in a facing direction of the pair of principal surfaces, each of the first terminal electrode and the second terminal electrode is extended in the facing direction with at least a part being arranged on an inner side of the element body compared to the end surfaces, the coil includes a first connection part and a second connection part respectively joined to the first terminal electrode and the second terminal electrode, the first connection part is connected to one end part of the coil, which part is placed on a side of one principal surface, and is arranged in an identical dielectric layer with a conductor included in the one end part, the second connection part is connected to the other end part of the coil, which part is placed on a side of the other principal surface, and is arranged in an identical dielectric layer with a conductor included in the other end part, and a recessed part is provided in each of the first terminal electrode and the second terminal electrode in the element body.

In the multilayer coil component according to the one aspect of the present invention, each of the first terminal electrode and the second terminal electrode is extended in the facing direction with at least a part being arranged on the inner side of the element body compared to the end surfaces. In the first connection part and the second connection part respectively joined to the first terminal electrode and the second terminal electrode, the first connection part is connected to the one end part of the coil, which part is placed on a side of the one principal surface, and is arranged in an identical dielectric layer with the conductor included in the one end part, and the second connection part is connected to the other end part of the coil, which part is placed on a side of the other principal surface, and is arranged in an identical dielectric layer with the conductor included in the other end part. With this configuration, in the multilayer coil component, it is possible to respectively connect the first terminal electrode and the second terminal electrode to the one end part and the other end part of the coil without a through hole conductor. Thus, it is possible to secure reliability in connection between the coil and the terminal electrode in the multilayer coil component.

In the multilayer coil component, the recessed part is provided in each of the first terminal electrode and the second terminal electrode in the element body. With this arrangement, it is possible to reduce volume of the first terminal electrode and the second terminal electrode in the multilayer coil component. Thus, it is possible to control a decrease in a Q-value since it is possible to reduce a loss due to an eddy current in the multilayer coil component.

In one embodiment, recessed parts may be respectively provided in positions facing each other in a first terminal electrode and a second terminal electrode. A coil is arranged between the first terminal electrode and the second terminal electrode. Thus, the positions facing each other in the first terminal electrode and the second terminal electrode are in the vicinity of the coil and a magnetic flux is likely to pass there. Thus, it is possible to further control a decrease in a Q-value since it is possible to more securely reduce a loss due to an eddy current by providing the recessed parts in the positions facing each other in the first terminal electrode and the second terminal electrode.

In one embodiment, a recessed part may be arranged in a position facing at least one of a pair of side surfaces in each of a first terminal electrode and a second terminal electrode. With this configuration, it is possible to securely reduce volume of the first terminal electrode and the second terminal electrode. Thus, it is possible to control a decrease in a Q-value since it is possible to reduce a loss due to an eddy current in a multilayer coil component.

According to the one aspect of the present invention, it is possible to control a decrease in a Q-value while securing reliability in connection between a coil and a terminal electrode.

DETAILED DESCRIPTION

In the following, a preferred embodiment of the present invention will be described in detail with reference to the attached drawings. Note that the same reference sign is assigned to an identical or equivalent elements and overlapped description is omitted in the description of the drawings.

Figure 1:
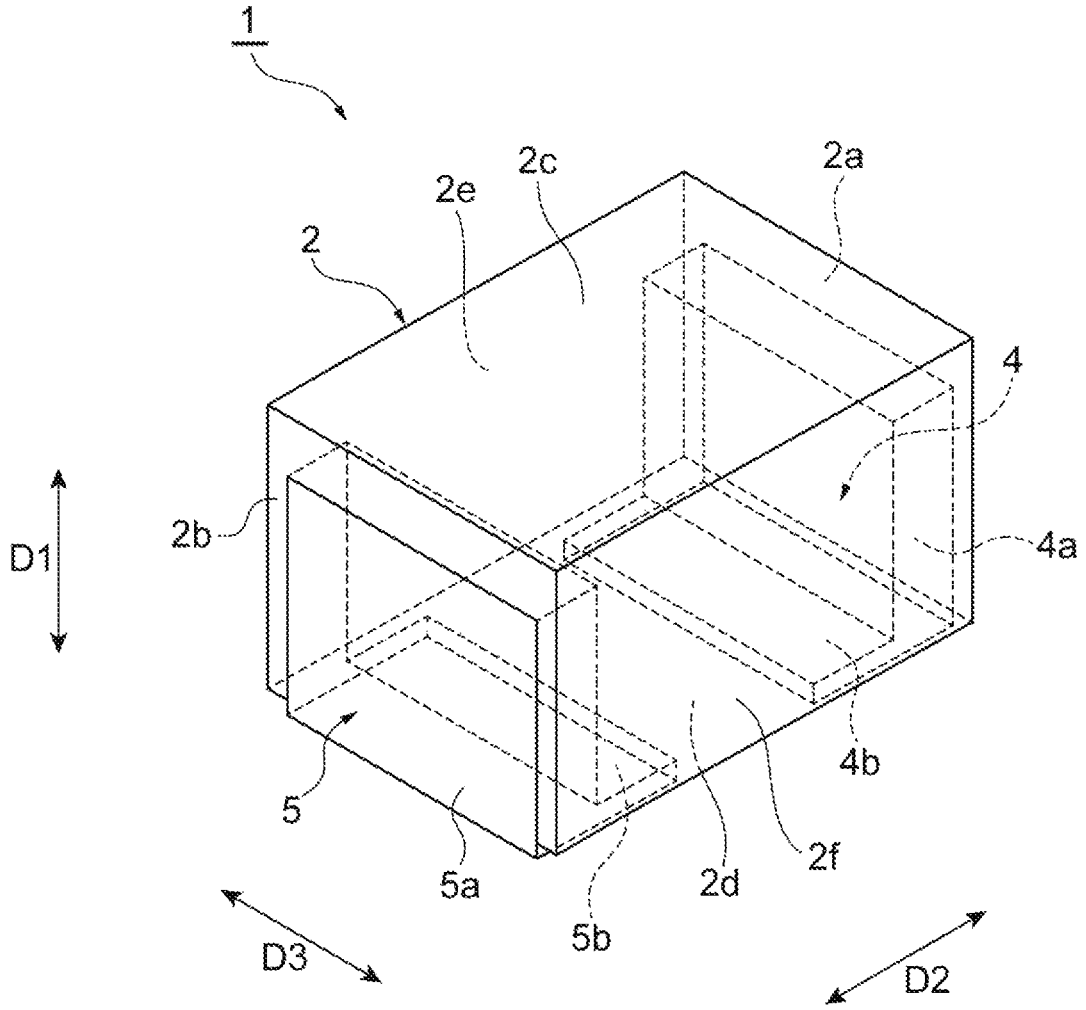
FIG. 1 is a perspective view of a multilayer coil component according to an embodiment.

As illustrated in FIG. 1, a multilayer coil component 1 includes an element body 2, and a first terminal electrode 4 and a second terminal electrode 5 respectively arranged in both end parts of the element body 2.

The element body 2 has a cuboid shape. The cuboid shape includes a shape of a cuboid in which a corner part and a ridge line part are chamfered, and a shape of a cuboid in which a corner part and a ridge line part are rounded. The element body 2 has, as outer surfaces thereof, a pair of end surfaces 2*a* and 2*b* facing each other, a pair of principal surfaces 2*c* and 2*d* facing each other, and a pair of side surfaces 2*e* and 2*f* facing each other. A facing direction in which the pair of principal surfaces 2*c* and 2*d* face each other is a first direction D1. A facing direction in which the pair of end surfaces 2*a* and 2*b* face each other is a second direction D2. A facing direction in which the pair of side surfaces 2*e* and 2*f* face each other is a third direction D3. In the present embodiment, the first direction D1 is a height direction of the element body 2. The second direction D2 is a longitudinal direction of the element body 2 and is orthogonal to the first direction D1. The third direction D3 is a width direction of the element body 2 and is orthogonal to the first direction D1 and the second direction D2.

The pair of end surfaces 2*a* and 2*b* are extended in the first direction D1 in such a manner as to couple the pair of principal surfaces 2*c* and 2*d*. The pair of end surfaces 2*a* and 2*b* are also extended in the third direction D3 (short side direction of pair of principal surface 2*c* and 2*d*). The pair of side surfaces 2*e* and 2*f* are extended in the first direction D1 in such a manner as to couple the pair of principal surfaces 2*c* and 2*d*. The pair of side surfaces 2*e* and 2*f* are also extended in the second direction D2 (long side direction of pair of end surface 2*a* and 2*b*). In the present embodiment, the principal surface 2*d* is prescribed as a mounting surface facing a different electronic device (such as circuit board or electronic component) when the multilayer coil component 1 is mounted to the different electronic device.

Figure 2:
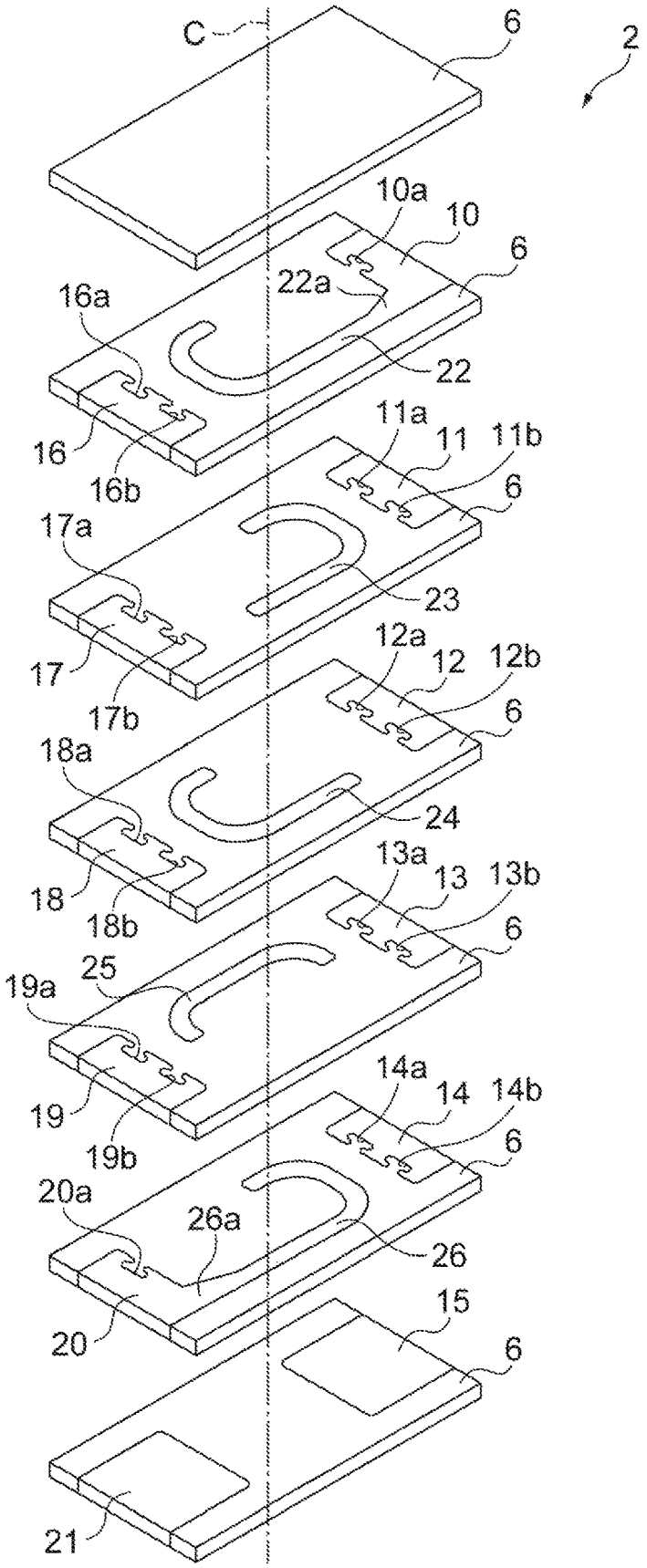
FIG. 2 is an exploded perspective view of an element body of the multilayer coil component.

As illustrated in FIG. 2, the element body 2 is configured by lamination of a plurality of dielectric layers (insulation layer) 6 in the direction in which the pair of principal surfaces 2*c* and 2*d* face each other. In the element body 2, a lamination direction of the plurality of dielectric layers 6 (hereinafter, simply referred to as "lamination direction") corresponds to the first direction D1. Each dielectric layer 6 includes, for example, a sintered body of a ceramic green sheet including a dielectric material (such as $BaTiO_3$-based, $Ba(Ti,Zr)O_3$-based, or $(Ba,Ca)TiO_3$-based dielectric ceramic). In an actual element body 2, the dielectric layers 6 are integrated in a degree in which a border between the dielectric layers 6 cannot be visually recognized.

The first terminal electrode 4 is arranged on a side of the end surface 2*a* of the element body 2, and the second terminal electrode 5 is arranged on a side of the end surface 2*b* of the element body 2. That is, the first terminal electrode 4 and the second terminal electrode 5 are placed in a manner of being separated from each other in the facing direction of the pair of end surfaces 2*a* and 2*b*. The first terminal electrode 4 and the second terminal electrode 5 include a conductive material (such as Ag or Pd). Each of the first terminal electrode 4 and the second terminal electrode 5 is configured as a sintered body of a conductive paste including a conductive metal powder (such as Ag powder or Pd powder). On a surface of each of the first terminal electrode 4 and the second terminal electrode 5, a plating layer is formed by electroplating. For example, Ni, Sn, or the like is used for electroplating.

A part of the first terminal electrode 4 is buried in the element body 2. The first terminal electrode 4 is arranged across the end surface 2*a* and the principal surface 2*d*. In the present embodiment, a surface of the first terminal electrode 4 which surface is along the end surface 2*a* is flush with the end surface 2*a*. A surface of the first terminal electrode 4 which surface is along the principal surface 2*d* is protruded from the principal surface 2*d*.

The first terminal electrode 4 has an L-shape when seen in the third direction D3. The first terminal electrode 4 has a first electrode part 4*a* and a second electrode part 4*b*. The first electrode part 4*a* and the second electrode part 4*b* are connected in a ridge line part of the element body 2 and are electrically connected to each other. The first electrode part 4*a* is extended in the first direction D1. The second electrode part 4*b* is extended in the second direction D2. The first electrode part 4*a* and the second electrode part 4*b* are extended in the third direction D3.

As illustrated in FIG. 2, the first terminal electrode 4 is configured by lamination of a plurality of electrode layers 10 to 15. Each of the electrode layers 10 to 15 is provided in a recessed part of the dielectric layer 6. When a recessed part is formed in the dielectric layer 6, and the recessed part is filled with a conductive paste and burned, the electrode layers 10 to 15 are formed. Each of the electrode layers 10 to 15 is arranged on the dielectric layer 6. Note that the dielectric layer 6 illustrated in FIG. 2 is configured by lamination of a dielectric layer in which the electrode layers 10 to 15 are arranged, and a dielectric layer in which a pattern corresponding to a shape of the electrode layers 10 to 15 is provided (pattern sheet).

A recessed part 10*a* is provided in the electrode layer 10. The recessed part 10*a* has a substantially trapezoid shape when seen in the first direction D1. The recessed part 10*a* is provided in a position facing the second terminal electrode 5 in the second direction D2. A size of the recessed part 10*a* is arbitrarily set.

Recessed parts 11*a* and 11*b* are provided in the electrode layer 11. Each of the recessed parts 11*a* and 11*b* has a substantially trapezoid shape when seen in the first direction D1. The recessed parts 11*a* and 11*b* are provided in positions facing the second terminal electrode 5 in the second direction D2. The recessed part 11*a* and the recessed part 11*b* are arranged at a predetermined distance in the third direction D3.

Recessed parts 12*a* and 12*b* are provided in the electrode layer 12. Each of the recessed parts 12*a* and 12*b* has a substantially trapezoid shape when seen in the first direction D1. The recessed parts 12*a* and 12*b* are provided in positions facing the second terminal electrode 5 in the second direction D2. The recessed part 12*a* and the recessed part 12*b* are arranged at a predetermined distance in the third direction D3.

Recessed parts 13*a* and 13*b* are provided in the electrode layer 13. Each of the recessed parts 13*a* and 13*b* has a substantially trapezoid shape when seen in the first direction D1. The recessed parts 13*a* and 13*b* are provided in positions facing the second terminal electrode 5 in the second direction D2. The recessed part 13*a* and the recessed part 13*b* are arranged at a predetermined distance in the third direction D3.

Recessed parts 14*a* and 14*b* are provided in the electrode layer 14. Each of the recessed parts 14*a* and 14*b* has a substantially trapezoid shape when seen in the first direction D1. The recessed parts 14*a* and 14*b* are provided in positions facing the second terminal electrode 5 in the second direction D2. The recessed part 14*a* and the recessed part 14*b* are arranged at a predetermined distance in the third direction D3.

The electrode layer 15 is included in the second electrode part 4*b* of the first terminal electrode 4. The electrode layer 15 has a rectangular shape when seen in the first direction D1.

Figure 4:
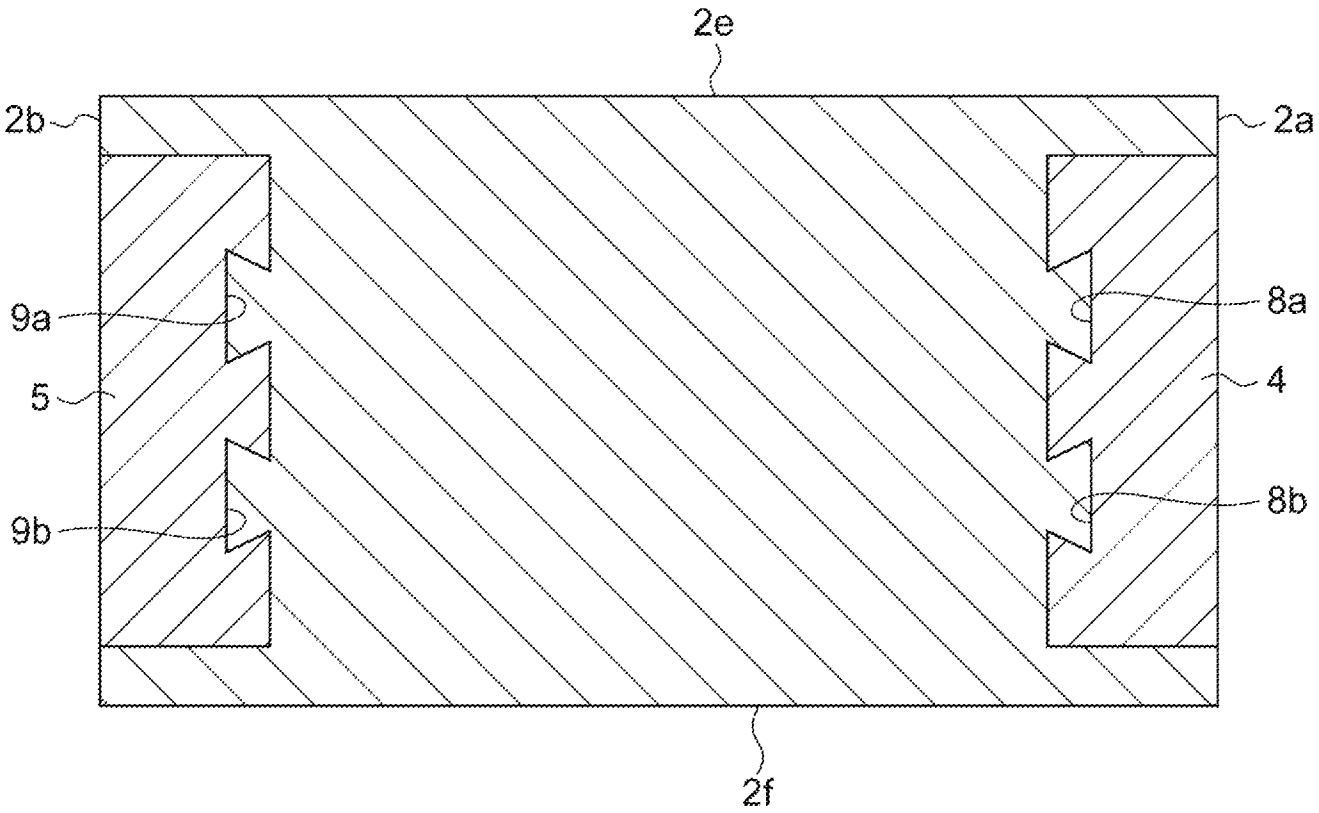
FIG. 4 is a view illustrating a sectional configuration of the multilayer coil component.

As illustrated in FIG. 4, in the first terminal electrode 4, recessed parts 8*a* and 8*b* extended in the first direction D1 are formed by lamination of the electrode layers 10 to 15. More specifically, the recessed part 8*a* includes the recessed part 10*a*, the recessed part 11*a*, the recessed part 12*a*, the recessed part 13*a*, and the recessed part 14*a*. The recessed part 8*b* includes the recessed part 11*b*, the recessed part 12*b*, the recessed part 13*b*, and the recessed part 14*b*.

Figure 3:
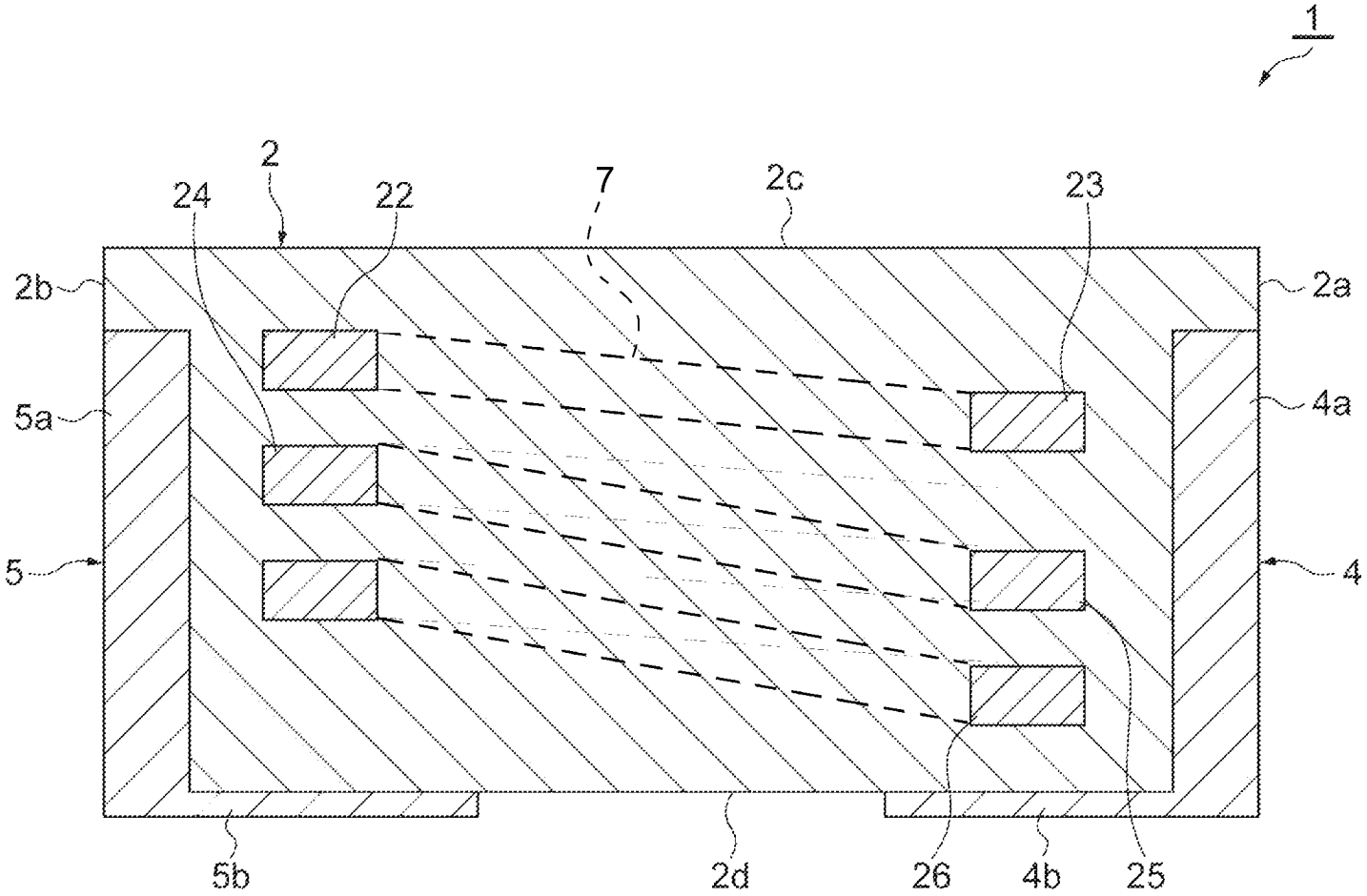
FIG. 3 is a view illustrating a sectional configuration of the multilayer coil component.

As illustrated in FIG. 3, a part of the second terminal electrode 5 is buried in the element body 2. The second terminal electrode 5 is arranged across the end surface 2*b* and the principal surface 2*d*. In the present embodiment, a surface of the second terminal electrode 5 which surface is along the end surface 2*b* is flush with the end surface 2*b*. A surface of the second terminal electrode 5 which surface is along the principal surface 2*d* is protruded from the principal surface 2*d*.

The second terminal electrode 5 has an L-shape when seen in the third direction D3. The second terminal electrode 5 has a first electrode part 5*a* and a second electrode part 5*b*. The first electrode part 5*a* and the second electrode part 5*b* are connected in a ridge line part of the element body 2 and are electrically connected to each other. The first electrode part 5*a* is extended in the first direction D1. The second electrode part 5*b* is extended in the second direction D2. The first electrode part 5*a* and the second electrode part 5*b* are extended in the third direction D3.

As illustrated in FIG. 2, the second terminal electrode 5 is configured by lamination of a plurality of electrode layers 16 to 21. Each of the electrode layers 16 to 21 is provided in a recessed part of the dielectric layer 6. When a recessed part is formed in the dielectric layer 6, and the recessed part is filled with a conductive paste and burned, the electrode layers 16 to 21 are formed. The electrode layers 16 to 21 are formed by a method similar to that of the electrode layers 10 to 15. Each of the electrode layers 16 to 21 is arranged on the dielectric layer 6. Note that the dielectric layer 6 illustrated in FIG. 2 is configured by lamination of a dielectric layer in which the electrode layers 16 to 21 are arranged, and a dielectric layer in which a pattern corresponding to a shape of the electrode layers 16 to 21 is provided (pattern sheet).

The electrode layer 16 is arranged in an identical dielectric layer 6 with the electrode layer 10. The electrode layer 16 is arranged in such a manner as to face the electrode layer 10 in the second direction D2. Recessed parts 16*a* and 16*b* are provided in the electrode layer 16. Each of the recessed parts 16*a* and 16*b* has a substantially trapezoid shape when seen in the first direction D1. The recessed parts 16*a* and 16*b* are provided in positions facing the first terminal electrode 4 (electrode layer 10) in the second direction D2. The recessed part 16*a* and the recessed part 16*b* are arranged at a predetermined distance in the third direction D3.

The electrode layer 17 is arranged in an identical dielectric layer 6 with the electrode layer 11. The electrode layer 17 is arranged in such a manner as to face the electrode layer 11 in the second direction D2. Recessed parts 17*a* and 17*b* are provided in the electrode layer 17. Each of the recessed parts 17*a* and 17*b* has a substantially trapezoid shape when seen in the first direction D1. The recessed parts 17*a* and 17*b* are provided in positions facing the first terminal electrode 4 (electrode layer 11) in the second direction D2. The recessed part 17*a* and the recessed part 17*b* are arranged at a predetermined distance in the third direction D3.

The electrode layer 18 is arranged in an identical dielectric layer 6 with the electrode layer 12. The electrode layer 18 is arranged in such a manner as to face the electrode layer 12 in the second direction D2. Recessed parts 18*a* and 18*b* are provided in the electrode layer 18. Each of the recessed parts 18*a* and 18*b* has a substantially trapezoid shape when seen in the first direction D1. The recessed parts 18*a* and 18*b* are provided in positions facing the first terminal electrode 4 (electrode layer 12) in the second direction D2. The recessed part 18*a* and the recessed part 18*b* are arranged at a predetermined distance in the third direction D3.

The electrode layer 19 is arranged in an identical dielectric layer 6 with the electrode layer 13. The electrode layer 19 is arranged in such a manner as to face the electrode layer 13 in the second direction D2. Recessed parts 19*a* and 19*b* are provided in the electrode layer 19. Each of the recessed parts 19*a* and 19*b* has a substantially trapezoid shape when seen in the first direction D1. The recessed parts 19*a* and 19*b* are provided in positions facing the first terminal electrode 4 (electrode layer 13) in the second direction D2. The recessed part 19*a* and the recessed part 19*b* are arranged at a predetermined distance in the third direction D3.

The electrode layer 20 is arranged in an identical dielectric layer 6 with the electrode layer 14. The electrode layer 20 is arranged in such a manner as to face the electrode layer 14 in the second direction D2. A recessed part 20*a* is provided in the electrode layer 20. The recessed part 20*a* has a substantially trapezoid shape when seen in the first direction D1. The recessed part 20*a* is provided in a position facing the first terminal electrode 4 (electrode layer 14) in the second direction D2.

An electrode layer 21 is included in the second electrode part 5*b* of the second terminal electrode 5. The electrode layer 21 has a rectangular shape when seen in the first direction D1. The electrode layer 21 is arranged in an identical dielectric layer 6 with the electrode layer 15. The electrode layer 21 is arranged in such a manner as to face the electrode layer 15 in the second direction D2.

As illustrated in FIG. 4, in the second terminal electrode 5, recessed parts 9*a* and 9*b* extended in the first direction D1 are formed by lamination of the electrode layers 16 to 20. More specifically, the recessed part 9*a* includes the recessed part 16*a*, the recessed part 17*a*, the recessed part 18*a*, the recessed part 19*a*, and the recessed part 20*a*. The recessed part 9*b* includes the recessed part 16*b*, the recessed part 17*b*, the recessed part 18*b*, and the recessed part 19*b*.

As illustrated in FIG. 3, the second electrode part 4*b* of the first terminal electrode 4 and the second electrode part 5*b* of the second terminal electrode 5 are protruded to an outer side of the principal surface 2*d* in the first direction D1. A dimension H between the principal surface 2*d* and surfaces of the second electrode part 4*b* and the second electrode part 5*b* is arbitrarily set. The second electrode part 4*b* and the second electrode part 5*b* are arranged at a predetermined distance in the second direction D2.

As illustrated in FIG. 3, a coil 7 is arranged in the element body 2 in the multilayer coil component 1. A coil axis C of the coil 7 is extended in the third direction D3. As illustrated in FIG. 2, the coil 7 includes a first conductor 22, a second conductor 23, a third conductor 24, a fourth conductor 25, and a fifth conductor 26 connected electrically. Each of the conductors 22 to 26 has a predetermined thickness in the third direction D3. Each of the conductors 22 to 26 includes a conductive material (such as Ag or Pd). Each of the conductors 22 to 26 is configured as a sintered body of a conductive paste including the conductive material. In the present embodiment, the conductors 22 to 26 (coil 7) include the same conductive material with the first terminal electrode 4 and the second terminal electrode 5. The conductors 22 to 26, the electrode layers 10 to 15, and the electrode layers 16 to 21 are formed by simultaneous burning. Each of the conductors 22 to 26 is arranged on the dielectric layer 6. Note that the dielectric layer 6 illustrated in FIG. 2 is configured by lamination of a dielectric layer in which each of the conductors 22 to 26 is arranged, and a dielectric layer in which a pattern corresponding to a shape of each of the conductors 22 to 26 is provided (pattern sheet).

The first conductor 22, the second conductor 23, the third conductor 24, the fourth conductor 25, and the fifth conductor 26 are arranged in sequence from one principal surface 2*c* to the other principal surface 2*d* of the element body 2. That is, the first conductor 22 is arranged on a side of the one principal surface 2*c*. The fifth conductor 26 is arranged on a side of the other principal surface 2*d*.

The first conductor 22 and the second conductor 23 are electrically connected by a through hole conductor (not illustrated). The second conductor 23 and the third conductor 24 are electrically connected by a through hole conductor (not illustrated). The third conductor 24 and the fourth conductor 25 are electrically connected by a through hole conductor (not illustrated). The fourth conductor 25 and the fifth conductor 26 are electrically connected by a through hole conductor (not illustrated).

One end part of the coil 7 and the first terminal electrode 4 are electrically connected by a first connection part 22*a*. Other end part of the coil 7 and the second terminal electrode 5 are electrically connected by a second connection part 26*a*.

The first connection part 22*a* is connected to the one end part of the coil 7. More specifically, the first connection part 22*a* is connected to an end part of the first conductor 22. The first connection part 22*a* is integrally formed with the first conductor 22 and is arranged in an identical dielectric layer 6 with the first conductor 22. The first connection part 22*a* is connected to the electrode layer 10. The first connection part 22*a* is integrally formed with the electrode layer 10. The first connection part 22*a* is formed by simultaneous burning with the first conductor 22 and the electrode layers 10 and 16.

The second connection part 26*a* is connected to the other end part of the coil 7. More specifically, the second connection part 26*a* is connected to an end part of the fifth conductor 26. The second connection part 26*a* is integrally formed with the fifth conductor 26 and is arranged in an identical dielectric layer 6 with the fifth conductor 26. The second connection part 26*a* is connected to the electrode layer 20. The second connection part 26*a* is integrally formed with the electrode layer 20. The second connection part 26*a* is formed by simultaneous burning with the fifth conductor 26 and the electrode layers 14 and 20.

As described above, in the multilayer coil component 1 according to the present embodiment, the first terminal electrode 4 and the second terminal electrode 5 are respectively arranged on an inner side of the element body 2 compared to the end surfaces 2*a* and 2*b* of the element body 2, and are extended in the first direction D1. In the first connection part 22*a* and the second connection part 26*a* respectively joined to the first terminal electrode 4 and the second terminal electrode 5, the first connection part 22*a* is connected to the one end part of the coil 7, which part is placed on a side of the one principal surface 2*c*, and is arranged in an identical dielectric layer 6 with the first conductor 22 included in the one end part. The second connection part 26*a* is connected to the other end part of the coil 7, which part is placed on a side of the other principal surface 2*d*, and is arranged in an identical dielectric layer 6 with the fifth conductor 26 included in the other end part. With this configuration, in the multilayer coil component 1, it is possible to respectively connect the first terminal electrode 4 and the second terminal electrode 5 to the one end part and the other end part of the coil 7 with no through hole conductor. Thus, in the multilayer coil component 1, reliability of connection between the coil 7 and the first terminal electrode 4 and the second terminal electrode 5 can be secured.

In the multilayer coil component 1, the recessed parts 8*a* and 8*b* and the recessed parts 9*a* and 9*b* are respectively provided in the first terminal electrode 4 and the second terminal electrode 5 in the element body 2. With this arrangement, it is possible to reduce volume of the first terminal electrode 4 and the second terminal electrode 5 in the multilayer coil component 1. Thus, it is possible to control a decrease in a Q-value since it is possible to reduce a loss due to an eddy current in the multilayer coil component 1.

Figure 5:
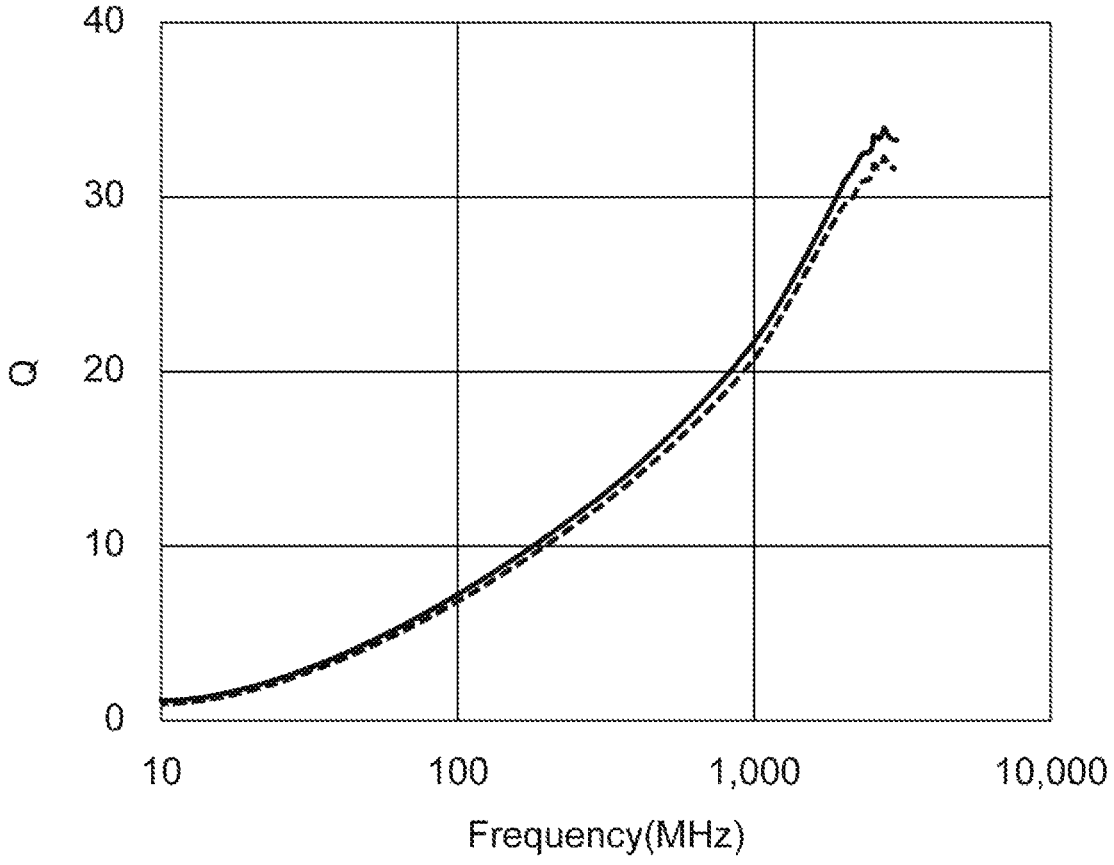
FIG. 5 is a graph illustrating a relationship between a frequency and a Q-value.

FIG. 5 is a graph illustrating a relationship between a frequency and a Q-value of a multilayer coil component according to a comparison example and that of the multilayer coil component according to the present embodiment.

Figure 6A:
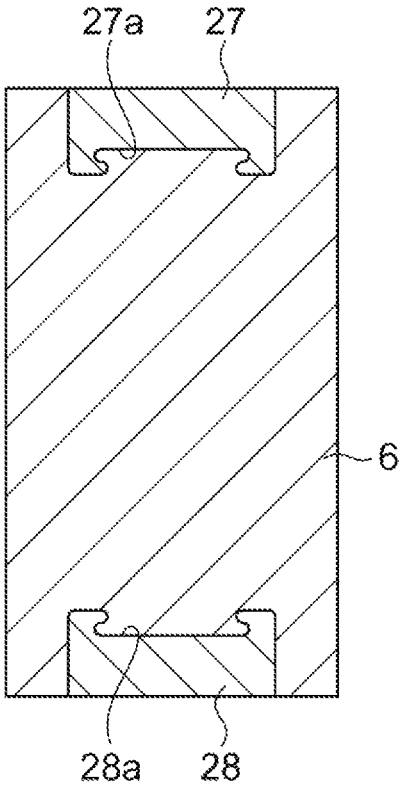
FIG. 6A is a sectional view illustrating a first terminal electrode and a second terminal electrode in each of which a recessed part is provided.
Figure 6B:
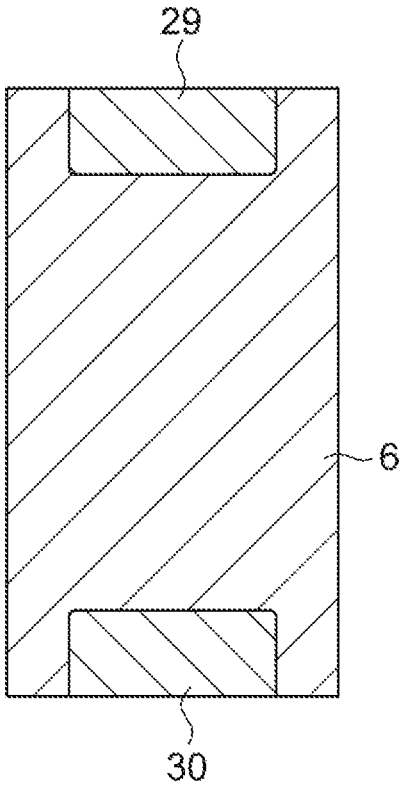
FIG. 6B is a sectional view illustrating a first terminal electrode and a second terminal electrode in which no recessed part is provided.

In FIG. 5, a simulation result of the multilayer coil component according to the comparison example is indicated by a dotted line and a simulation result of the multilayer coil component 1 is indicated by a solid line. In FIG. 5, a horizontal axis indicates a frequency [MHz] and a vertical axis indicates a Q-value. As illustrated in FIG. 6A, in a multilayer coil component a result of which is indicated by the solid line in FIG. 5, a recessed part 27*a* is provided in a first terminal electrode 27, and a recessed part 28*a* is provided in a second terminal electrode 28. The recessed part 27*a* and the recessed part 28*a* are respectively provided in positions facing each other in the first terminal electrode 27 and the second terminal electrode 28. As illustrated in FIG. 6B, no recessed part is provided in a first terminal electrode 29 and a second terminal electrode 30 of a multilayer coil component in a related art.

As illustrated in FIG. 5, a result that a Q-value of the multilayer coil component including the first terminal electrode 27 in which the recessed part 27*a* is provided and the second terminal electrode 28 in which the recessed part 28*a* is provided is improved compared to that of the multilayer coil component in which no recessed part is provided is acquired. Thus, in the multilayer coil component 1 including the first terminal electrode 4 in which the recessed parts 8*a* and 8*b* are provided and the second terminal electrode 5 in which the recessed parts 9*a* and 9*b* are provided, a decrease in a Q-value can be controlled since a loss due to an eddy current can be reduced.

In the multilayer coil component 1 according to the present embodiment, the recessed parts 8*a* and 8*b* of the first terminal electrode 4 are provided in positions facing the second terminal electrode 5, and the recessed parts 9*a* and 9*b* of the second terminal electrode 5 are provided in positions facing the first terminal electrode 4. The coil 7 is arranged between the first terminal electrode 4 and the second terminal electrode 5. In the first terminal electrode 4 and the second terminal electrode 5, the positions facing each other are in the vicinity of the coil 7, and a magnetic flux is likely to pass there. Thus, in the multilayer coil component 1, it is possible to further control a decrease in a Q-value since it is possible to more securely reduce a loss due to an eddy current by respectively providing the recessed parts 8*a* and 8*b* and the recessed parts 9*a* and 9*b* in the positions facing each other in the first terminal electrode 4 and the second terminal electrode 5.

As illustrated in FIG. 3, in the multilayer coil component 1 according to the present embodiment, the second electrode part 4*b* of the first terminal electrode 4 and the second electrode part 5*b* of the second terminal electrode 5 are protruded in the first direction D1 compared to the principal surface 2*d*. The second electrode part 4*b* of the first terminal electrode 4 and the second electrode part 5*b* of the second terminal electrode 5 are arranged at a predetermined distance in the second direction D2. With this arrangement, an indent (recessed part) is formed by the second electrode part 4*b* of the first terminal electrode 4, the second electrode part 5*b* of the second terminal electrode 5, and the principal surface 2*d*.

There is a case where the multilayer coil component 1 is covered by a resin mold when mounted to a circuit board or the like. In this case, when the resin mold is formed, resin flows into the indent formed by the second electrode part 4*b* of the first terminal electrode 4, the second electrode part 5*b* of the second terminal electrode 5, and the principal surface 2*d* and a resin layer (resin part) is formed in the indent. Accordingly, in the multilayer coil component 1, a flow of melted solder is blocked by the resin layer formed in the indent in a case where reflow soldering is performed after forming of the resin mold. Thus, in the multilayer coil component 1, generation of a trouble such as short-circuiting of the first terminal electrode 4 and the second terminal electrode 5 due to electrical connection between the first terminal electrode 4 and the second terminal electrode 5 by melted solder can be avoided.

In the above, an embodiment of the present invention has been described. However, the present invention is not necessarily limited to the above-described embodiment, and various modifications can be made within the spirit and the scope thereof.

In the above embodiment, a form in which the second electrode part 4*b* of the first terminal electrode 4 and the second electrode part 5*b* of the second terminal electrode 5 are protruded compared to the principal surface 2*d* has been described as an example. However, a second electrode part 4*b* of a first terminal electrode 4 and a second electrode part 5*b* of a second terminal electrode 5 may be flush with a principal surface 2*d*.

In the above embodiment, a form in which the first terminal electrode 4 includes the second electrode part 4*b* and the second terminal electrode 5 includes the second electrode part 5*b* has been described as an example. However, it is only necessary that a first terminal electrode 4 and a second terminal electrode 5 at least include first electrode parts 4*a* and 5*a* respectively.

In the above embodiment, a form in which a form (such as shape and number) of the recessed parts in the electrode layers 10 to 14 and a form of the recessed parts in the electrode layers 16 to 20 are the same has been described as an example. However, forms of recessed parts may be different in electrode layers.

In the above embodiment, a form in which the recessed parts 8*a* and 8*b* are provided in the first terminal electrode 4 and the recessed parts 9*a* and 9*b* are provided in the second terminal electrode 5 has been described as an example. However, a shape and the number of recessed parts are not limited to this.

Figure 7C:
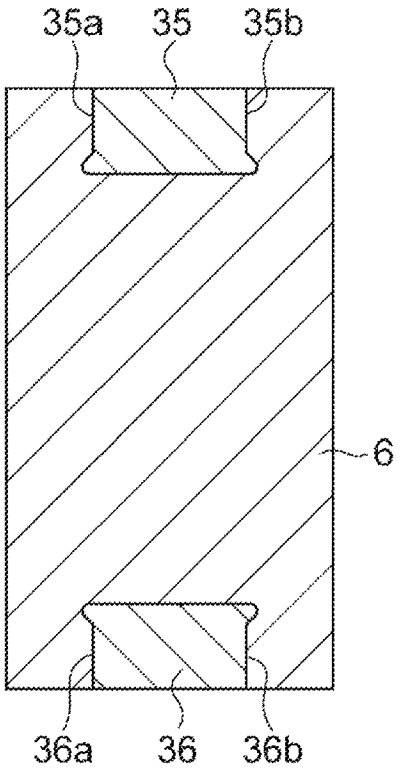
FIG. 7C is a view illustrating a first terminal electrode and a second terminal electrode of a multilayer coil component according to a different embodiment.
Figure 7B:
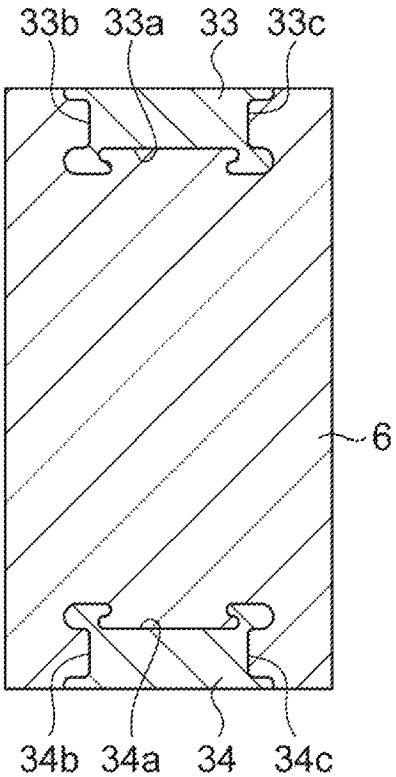
FIG. 7B is a view illustrating a first terminal electrode and a second terminal electrode of a multilayer coil component according to a different embodiment.
Figure 7A:
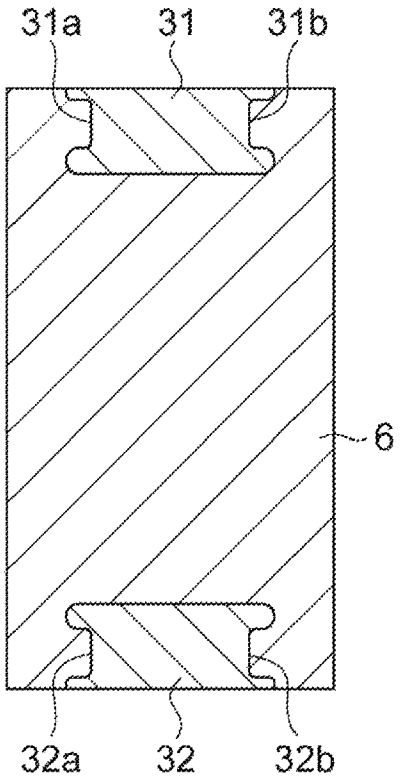
FIG. 7A is a view illustrating a first terminal electrode and a second terminal electrode of a multilayer coil component according to a different embodiment.

As illustrated in FIG. 7A, recessed parts 31*a* and 31*b* may be provided in a first terminal electrode 31 and recessed parts 32*a* and 32*b* may be provided in a second terminal electrode 32. The recessed parts 31*a* and 31*b* and the recessed parts 32*a* and 32*b* are arranged in positions facing at least one of a pair of side surfaces 2*e* and 2*f*.

As illustrated in FIG. 7B, recessed parts 33*a*, 33*b*, and 33*c* may be provided in a first terminal electrode 33 and recessed parts 34*a*, 34*b*, and 34*c* may be provided in a second terminal electrode 34. The recessed part 33*a* and the recessed part 34*a* are respectively provided in positions facing each other in the first terminal electrode 33 and the second terminal electrode 34. The recessed parts 33*b* and 33*c* and the recessed parts 34*b* and 34*c* are arranged in positions facing at least one of a pair of side surfaces 2*e* and 2*f*.

As illustrated in FIG. 7C, recessed parts 35*a* and 35*b* may be provided in a first terminal electrode 35, and recessed parts 36*a* and 36*b* may be provided in a second terminal electrode 36. The recessed parts 35*a* and 35*b* and the recessed parts 36*a* and 36*b* are arranged in positions facing at least one of a pair of side surfaces 2*e* and 2*f*.

Figure 8C:
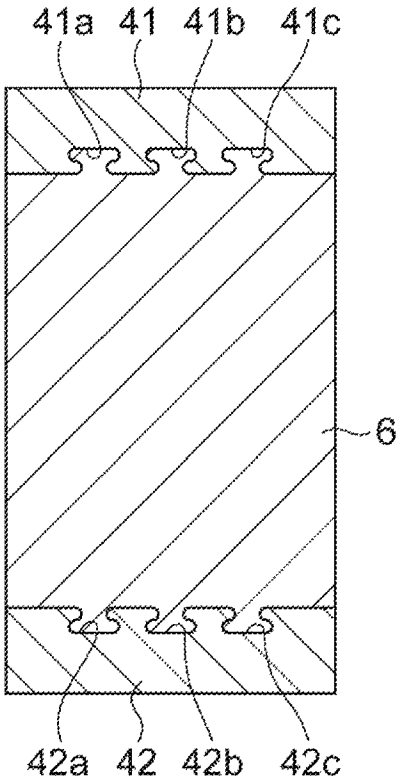
FIG. 8C is a view illustrating a first terminal electrode and a second terminal electrode of a multilayer coil component according to a different embodiment.
Figure 8B:
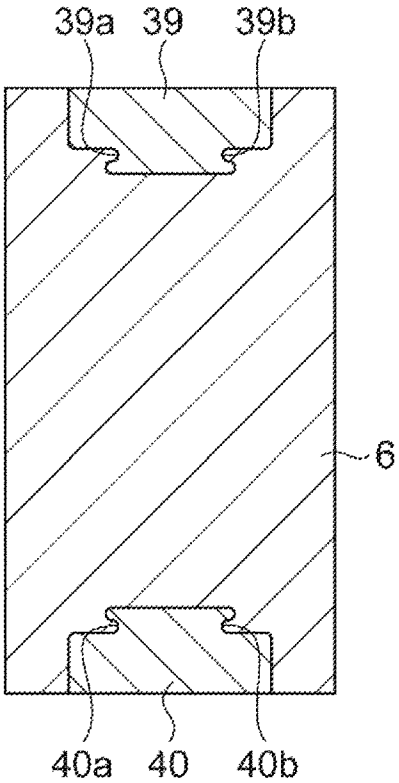
FIG. 8B is a view illustrating a first terminal electrode and a second terminal electrode of a multilayer coil component according to a different embodiment.
Figure 8A:
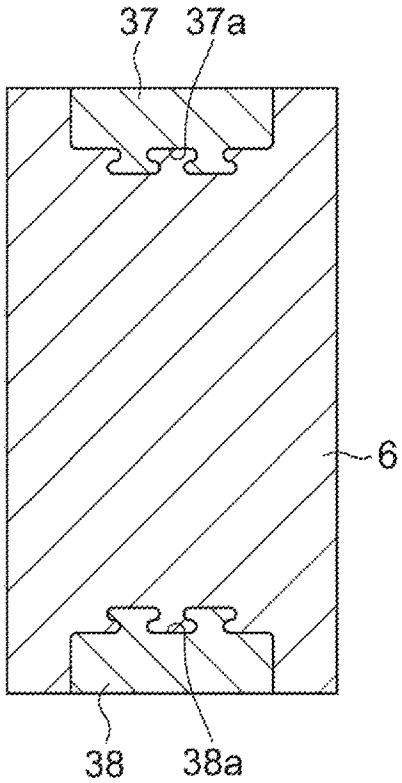
FIG. 8A is a view illustrating a first terminal electrode and a second terminal electrode of a multilayer coil component according to a different embodiment.

As illustrated in FIG. 8A, a recessed part 37*a* may be provided in a first terminal electrode 37, and a recessed part 38*a* may be provided in a second terminal electrode 38. The recessed part 37*a* and the recessed part 38*a* are respectively provided in positions facing each other in the first terminal electrode 37 and the second terminal electrode 38.

As illustrated in FIG. 8B, recessed parts 39*a* and 39*b* may be provided in a first terminal electrode 39, and recessed parts 40*a* and 40*b* may be provided in a second terminal electrode 40. The recessed parts 39*a* and 39*b* and the recessed parts 40*a* and 40*b* are arranged in positions facing at least one of a pair of side surfaces 2*e* and 2*f*.

As illustrated in FIG. 8C, recessed parts 41*a*, 41*b*, and 41*c* may be provided in a first terminal electrode 41 and recessed parts 42*a*, 42*b*, and 42*c* may be provided in a second terminal electrode 42. The recessed parts 41*a*, 41*b*, and 41*c* and the recessed parts 42*a*, 42*b*, and 42*c* are respectively provided in positions facing each other in the first terminal electrode 41 and the second terminal electrode 42. Also, the first terminal electrode 41 and the second terminal electrode 42 may be formed in such a manner as to be exposed to a pair of side surfaces 2*e* and 2*f* of an element body 2.

What is claimed is:

1. A multilayer coil component comprising:

an element body formed by lamination of a plurality of dielectric layers and having a pair of end surfaces facing each other, a pair of principal surfaces facing each other in a lamination direction of the plurality of dielectric layers, and a pair of side surfaces facing each other;

a coil configured by connection of a plurality of conductors in the element body; and a first terminal electrode having a first portion (i) extending in a facing direction of the pair of principal surfaces and (ii) at an outer side of a first end surface of the pair of end surfaces and a second terminal electrode having a second portion (i) extending in the facing direction and (ii) at an outer side of a second end surface of the pair of end surfaces, wherein a coil axis of the coil extends in the facing direction of the pair of principal surfaces, the first terminal electrode has a third portion orthogonal to the first portion and the second terminal electrode has a fourth portion orthogonal to the second portion, the third portion and the fourth portion are on a same one of the pair of principal surfaces, the first portion extends inwardly from the first end surface, the second portion extends inwardly from the second end surface, the coil includes a first connection part joined to the first terminal electrode and a second connection part joined to the second terminal electrode, the coil includes opposite first and second end parts, the first connection part is connected to the first end part of the coil and is in an identical dielectric layer with a conductor included in the first end part, the second connection part is connected to the second end part of the coil and is in an identical dielectric layer with a conductor included in the second end part, the first end part is closer to a first principal surface of the pair of principal surfaces than the second end part and the second end part is closer to a second principal surface of the pair of principal surfaces than the first end part, the first portion of the first terminal electrode has (i) a first innermost surface in a first direction toward and facing the second terminal electrode and (ii) a first recess (a) with a first opening in the first innermost surface and (b) extending outwardly from the first innermost surface, away from the second terminal electrode, the second portion of the second terminal electrode has (i) a second innermost surface in a second direction toward and facing the first terminal electrode and (ii) a second recess (a) with a second opening in the second innermost surface and (b) extending outwardly from the second innermost surface, away from the first terminal electrode, a first width of the first opening in a side surface facing direction is less than a second width of the first recess in the side surface facing direction at a location other than the first opening, a third width of the second opening in the side surface facing direction is less than a fourth width of the second recess in the side surface facing direction at a location other than the second opening, and the first recess and the second recess extend continuously between the pair of principal surfaces in the facing direction.

2. The multilayer coil component according to claim 1, wherein the first recess of the first terminal electrode faces the second recess of the second terminal electrode.

3. The multilayer coil component according to claim 1, wherein the first recess and the second recess face at least one of the pair of side surfaces.

4. The multilayer coil component according to claim 1, wherein:

the coil has an internal opening along the coil axis defined by the plurality of conductors; and the third portion and the fourth portion overlap the internal opening when the multilayer coil component is viewed along the coil axis.

5. The multilayer coil component according to claim 1, wherein:

the first recess includes a first plurality of recesses spaced in the side surface facing direction; and the second recess includes a second plurality of recesses spaced in the side surface facing direction.

* * * * *